United States Patent [19]

Diehl et al.

[11] Patent Number: 4,676,455

[45] Date of Patent: Jun. 30, 1987

[54] GUIDE BEAM AND TRACKING SYSTEM

[75] Inventors: Christian Diehl, Munich; Werner Schnaebele, Wolfratshausen; Karl-Heinz Allgaier, Ottobrunn; Horst Kirsche, Munich, all of Fed. Rep. of Germany

[73] Assignee: Messerschmitt-Boelkow-Blohm Gesellschaft mit beschraenkter Haftung, Munich, Fed. Rep. of Germany

[21] Appl. No.: 798,759

[22] Filed: Nov. 15, 1985

[30] Foreign Application Priority Data

Nov. 16, 1984 [DE] Fed. Rep. of Germany ..... 3441921

[51] Int. Cl.[4] ..... F41G 7/26

[52] U.S. Cl. ..... 244/3.13; 89/41.06

[58] Field of Search ..... 244/3.13, 3.11, 3.14; 89/41.06; 350/354

[56] References Cited

U.S. PATENT DOCUMENTS

| | | | |
|---|---|---|---|
| 4,014,482 | 3/1977 | Esker et al. | 244/3.13 |
| 4,030,686 | 6/1977 | Buchman | 244/3.13 |
| 4,111,383 | 9/1978 | Allen et al. | 244/3.13 |
| 4,111,385 | 9/1978 | Allen | 244/3.13 |
| 4,202,246 | 5/1980 | Schertz et al. | 89/41.06 |
| 4,272,193 | 6/1981 | Eastman et al. | 356/349 |
| 4,330,099 | 5/1982 | Sogo et al. | 244/3.13 |
| 4,408,734 | 10/1983 | Koreicho | 244/3.13 |
| 4,432,511 | 2/1984 | Tong | 244/3.13 |
| 4,562,769 | 1/1986 | Heynau et al. | 89/41.06 |

FOREIGN PATENT DOCUMENTS 2658689 1/1983 Fed. Rep. of Germany .

*Primary Examiner*—Charles T. Jordan
*Assistant Examiner*—Stephen M. Johnson
*Attorney, Agent, or Firm*—W. G. Fasse; D. H. Kane, Jr.

[57] ABSTRACT

A guide beam and tracking system for acquiring a target and for guiding a flying body into the target operates in accordance with the beam rider principle. A tracking laser beam is imaged into the path of a guide laser beam so that both beams travel through the same optical devices and through the same deflection device. All components of the system, except the receiver are controlled by a central processing unit which may control one, two, or three laser generators to produce, in timed sequence, laser beams for different purposes. A highly precise target acquisition and a precise target tracking is achieved.

4 Claims, 5 Drawing Figures

GUIDE BEAM AND TRACKING SYSTEM

FIELD OF THE INVENTION

The invention relates to a guide beam and tracking system for steering flying bodies in accordance with the same beam rider principle employing a scanning laser beam and an optical arrangement of a guide laser beam aligned in parallel to the scanning laser beam. A reference laser beam and a receiver are also part of such a system.

DESCRIPTION OF THE PRIOR ART

German Pat. No. (DE-PS) 2,658,689 (Sago) discloses a method for guiding flying bodies employing a laser beam which is deflected on a spiral path for steering a flying object. A follower guiding or tracking relative to a sight line aimed at a target is not disclosed by this method.

U.S. Pat. No. 4,111,383 (Allen) describes a device for steering a flying body in accordance with the beam rider principle. The steering device employs lasers which are deflected in the x-y-coordinate directions for producing a guide beam. The known system further comprises a synchronizing laser and a telescope sight. In the known system, means for controlling the synchronizing laser are effective at points of time at which the beams of the guide beam lasers imaged into the sight cross the sight line to a target. This type of following or target tracking is rather slow in practice. Further, compared to the guide beam tracking of a flying body, the known system is rather unprecise.

OBJECTS OF THE INVENTION

In view of the foregoing it is the aim of the invention to achieve the following objects singly or in combination:

to provide a beam rider control or steering system for steering a flying body which is substantially simpler than conventional systems operating under the beam rider principle;

to use such a system also, or rather simultaneously, for a target acquisition and for target tracking purposes based on the target acquisition, whereby the precision in the target acquisition and tracking is the same or better than that of the beam rider principle employed for steering a flying body toward a target;

to employ the same laser beam generator for different purposes in a time multiplexing manner for using the same laser beam for guiding, tracking, and reference purposes; and to modify a beam rider tracking and guiding system for steering a flying body in such a manner, that the system can be used simultaneously for an equally precise target acquisition.

SUMMARY OF THE INVENTION

The guide beam and tracking system according to the invention employs a single laser which is controlled in a timed sequence for operating for at least two purposes, preferably even for three purposes so that the guide beam and the tracking beam are produced by the same laser in timed sequence. Preferably, not only the guide laser beam and the tracking laser beam are produced by the same laser generator, but also the reference beam is produced under the timed sequential control of the control unit, whereby a single solid state laser may be provided for these two or three purposes.

The present system operates in that the tracking beam is imaged into the guide laser beam path and both laser beams travel through the same x-y-deflection device and through the same optical device. The reflected light signals are supplied to a further optical device in a receiver which provides an output signal through an evaluation circuit to a control unit. The evaluation circuit measures the signal amplitude and the transit time and supplies a control signal to the input of the laser or lasers, to the input of a modulator of a reference laser beam, and to the input of a deflection device for controlling the deflection device in the x-y-direction.

In a further embodiment, a separate laser generator is provided for each of the three laser beams, namely a first laser generates the guide beam, a second laser generates the reference beam and a third laser generates the tracking beam. In this embodiment the first guide laser generates a spiral pattern for the location and time correlation of the flying body being steered. The second reference laser provides a clock signal in the form of light impulses and the third tracking laser scans the target silhouette. Thus, the light output rate per time unit is substantially increased by the use of three laser generators compared to using only one laser generator for all three purposes. This system also works substantially faster than the embodiments with time sharing or time multiplexing of the laser generator.

In both embodiments the advantage is achieved that the same system is used for target acquisition and for steering the flying body toward the target. Thus, the conventional use of a separate sighting apparatus is no longer necessary, whereby a substantial mechanical and optical simplification of the apparatus is possible, for example with regard to the optical alignment or harmonization of optical components. Additionally, a higher tracking precision is achieved according to the invention than is possible conventionally. However, conventional tracking means may be combined with the present system.

BRIEF DESCRIPTION OF THE DRAWINGS:

In order that the invention may be clearly understood, it will now be described, by way of example, with reference to the accompanying drawings, wherein.

DETAILED DESCRIPTION OF PREFERRED EMBODIMENTS AND OF THE BEST MODE OF THE INVENTION

Figure 1:
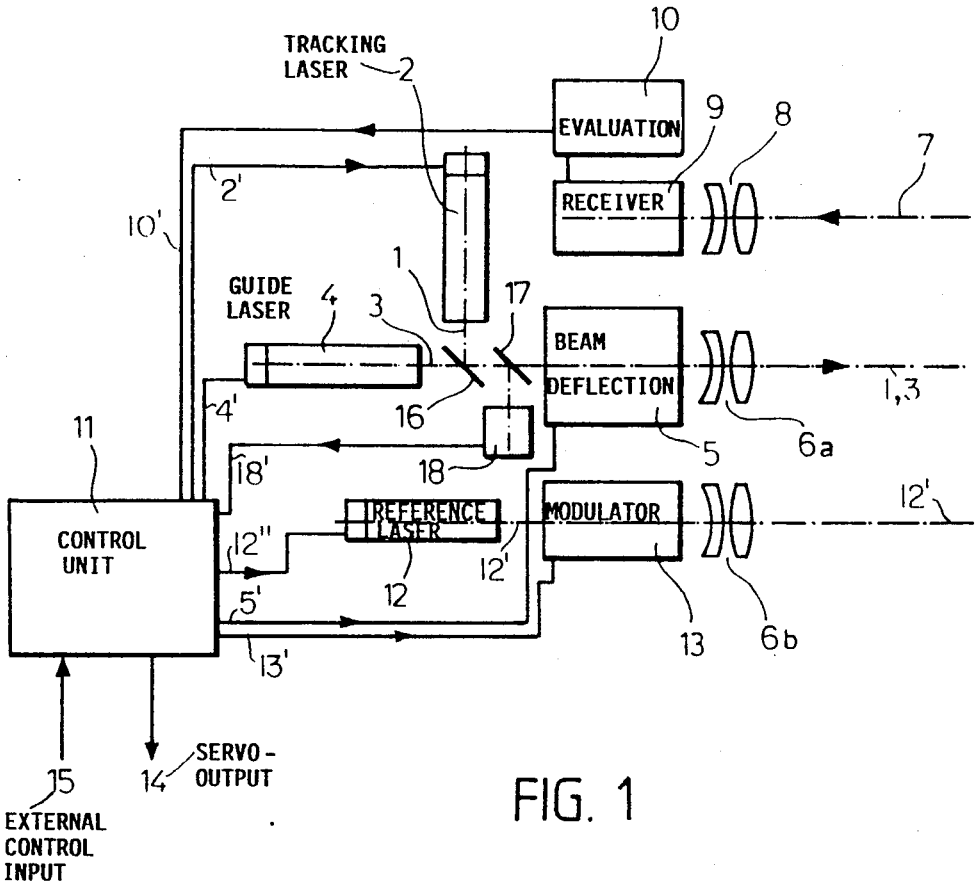
FIG. 1 is a block diagram of a guide beam and tracking system according to the invention, including three laser generators for producing a reference laser beam, a guide laser beam, and a tracking laser beam, laser projection devices, and a laser receiver.

FIG. 1 shows a simplified block diagram of a guide and tracking system according to the invention, including a projection section and a receiver section forming a control or steering system for flying bodies employing the beam rider principle. The system in the embodiment of FIG. 1 comprises three laser beam generators. The first laser beam generator 4 is a light source for generating a guide beam 3 which is deflected in a spiral pattern in the accoustic optical x-y-deflection unit 5. The guide beam 3 passes through an optical device 6*a*, for example, a zoom objective, out of the projector. The second laser beam generator 12 generates a reference laser beam 12′ for the timed synchronization of the operation. The reference laser beam 12′ is radiated through an accoustic optical modulator 13 and a further optical device 6b such as a lens system. The two mentioned lasers 4 and 12 are preferably solid state lasers for example, of the Nd-Yalo type.

The third laser beam generator 2, preferably also a solid state laser, for example, of Alexandrite or Nd-Yalo type, generates a tracking laser beam 1. The tracking beam 1 is imaged or coupled into the path of the guide laser beam 3 by means of a dichroic mirror 16. Thus, the tracking beam 1 also passes through a single accoustic optical deflection device 5 which is provided in common for the tracking laser beam and for the guide laser beam. The tracking beam 1 of the laser 2 serves for marking an image silhouette as will be described in more detail below. Both, the guide laser beam and the tracking laser beam also pass through said optical lens device 6*a* provided in common for the tracking laser beam and for the guide laser beam.

Light 7 scattered by a target 21 is received by a receiver 9 through an optical lens system 8. The output signal of the receiver 9 is supplied to the control unit 11 through an evaluating circuit arrangement 10. This control unit 11, which will be described in more detail below with reference to FIG. 5, coordinates all operational steps in the guide beam and tracking system, especially for controlling the laser generators 2, 4, and 12, the modulator 13 and the deflection device 5. The control unit 11 has a servo output 14 for controlling, for example, mechanical servo-drive units 41, 42 for tracking the guide beam projector 40 shown in FIG. 4. The control unit 11 has a signal output 12″ connected for controlling the reference laser generator 12. The position of a target 21 roughly acquired by an optical sighting device 43 may be supplied in the form of respective signals to the input 15 for aligning the guide beam and the tracking beam or rather the devices producing these beams. A further optical decoupling member such as a mirror 17 is located in the beam path 3 of the guide beam laser 4. The decoupling member 17 guides respectively a portion of the light radiated by the guide beam laser 4 and by the tracking laser 2, onto a detector 18, whereby the optical harmonizing of the guide beam 3 and of the tracking laser beam 1 may be accomplished through the control unit 11 having an input 18′ connected to the detector 18. The laser generators 2, 4, and 12 are connected to the control unit 11 at 2′, 4′, and 12″ respectively.

Figure 2:
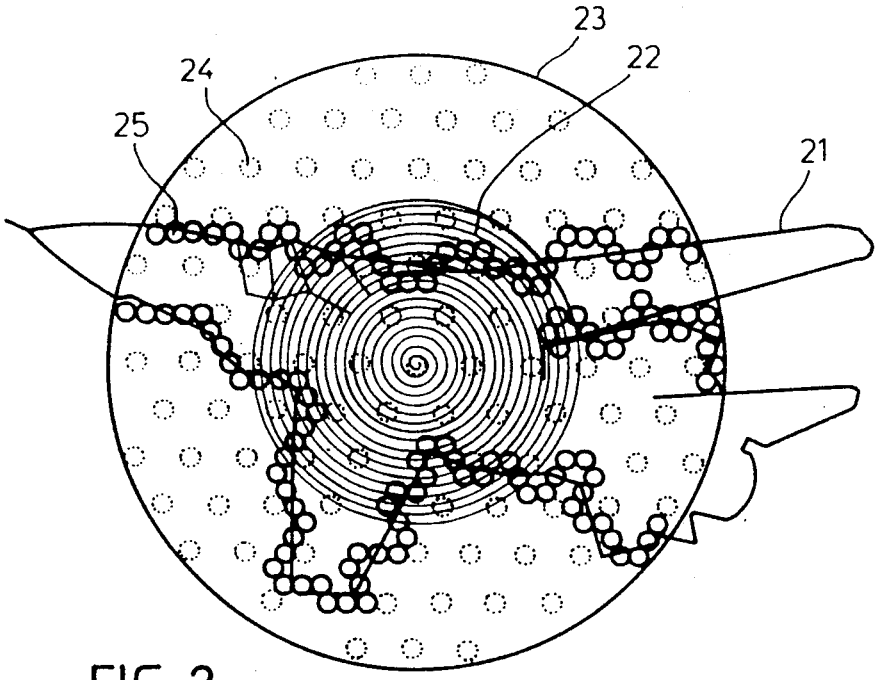
FIG. 2 illustrates a stylized target tracking image as generated by the system according to the invention.

Referring to FIG. 2, the function of the guide beam and tracking system according to the invention will now be described. FIG. 2 shows a target acquired and illuminated by the laser beams emanating from the guide beam laser 4 and from the tracking beam laser 2. The center of the illustration shows the track 22 of the guide beam 3 of the guide beam laser 4 as it is deflected in a spiral manner in the x-y-coordinate directions by the deflection device 5. Both, the guide beam laser 4 and the reference beam laser 12, serve for steering a flying body, such as an artillery shell or rocket to a target 21. The reference laser beam 12′ is modulated by the modulator 13.

Figure 4:
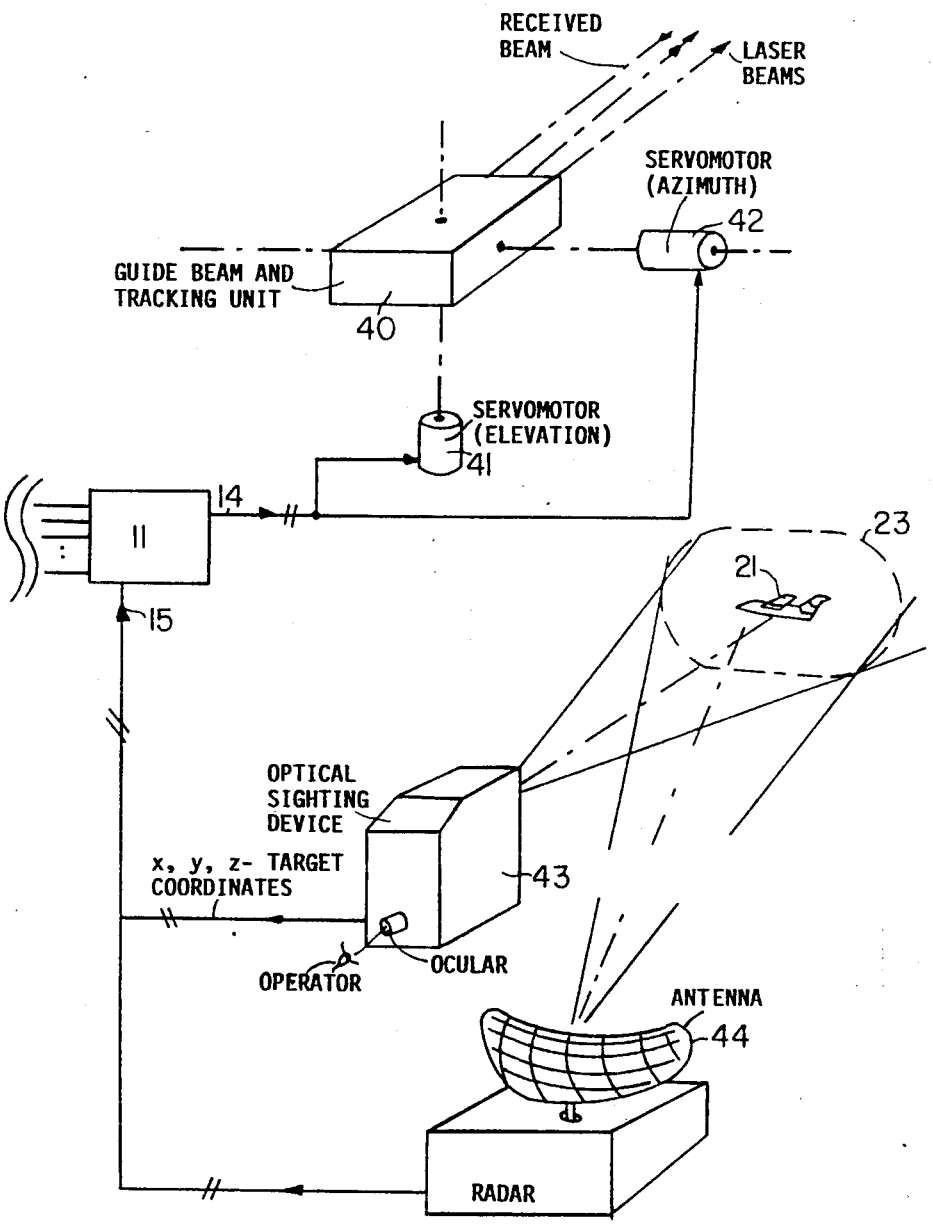
FIG. 4 is a simplified illustration of the arrangement for the position control of the guide beam laser and of the tracking beam laser.

Following each passage of the guide beam 3 of the guide beam laser 4, the tracking laser 2 is triggered through its input 2′. The tracking laser 2 is capable of pumping laser energy as long as the guide beam laser 4 and the reference beam laser 12 are operating so that the tracking laser 2 discharges its stored energy in a pulse. This pulse is used to illuminate one of the image points 24 illustrated in FIG. 2 by dotted circles. The acquisition of the image point 24 is accomplished by guiding the tracking laser beam 1 of the tracking laser 2 through the x-y-deflection device 5 which continues to operate also in the scanning gap between successive pulses of the guide laser beam 3. The deflection device 5 has a control input 5′ connected to the control unit 11. The scanning gap occurs because the guide beam laser 4 is switched off after it passed through a complete track 22 and before it begins a new scanning spiral track. Thus, the searching field 23 is being scanned for a possible target 21. The acquisition of a target 21 is achieved through the light 7 scattered back by the target 21 and received by the receiver 9 through optical members 8. The receiver 9 passes a respective received signal through an evaluation circuit arrangement 10 where the received light is evaluated relative to its intensity and relative to the transit time to obtain the distance to the target which is proportional to the transit time. Thus, disturbing influences are separated from target image points. When a target has been positively acquired, the control unit 11 makes sure, that for example, in accordance with a predetermined scheme which, for example, is shown in FIG. 2 is a wave type guiding of the scanning beam, only the edge points 25 of the target 21 are scanned. A program for this purpose is stored in the memory 45 of the control unit 11 which determines, based on the information representing the position of the edge points 25 in the scanning field 23, the area or surface center of gravity of the target 21. When this surface center of gravity has been located, the guide laser beam 3 of the guide beam laser generator 4 is directed onto that center of gravity by a signal passing out of the servo-output 14 of the control unit 11 for controlling a drive unit 41, 42 which moves the guide laser generator 4 or rather its tracking unit 40 into the proper position. In case further devices for acquiring a target are used, such as a sight 43 or a radar unit 44 as shown in FIG. 4, the respective output signals can be applied to the external control input 15 of the control unit 11 for processing by the control unit 11 in order to provide an initial information regarding the expected point of entrance of a target 21 into the search field 23 to thereby limit the searching operation of the tracking laser 2 to such point of entry.

It is also possible to trigger the tracking laser 2 already during the scanning operation of the guide beam laser 4 in order to achieve a more rapid scanning operation.

An advantageous embodiment of the invention may be accomplished in that only one laser is used instead of the guide beam laser 4 and the tracking laser 2. Such single laser would also be controlled by the central processing unit 11, however, in a timed sequence so that it may perform both functions. The advantage of this type of operation is seen in that no harmonizing between the two laser beams is necessary any more.

Figure 3:
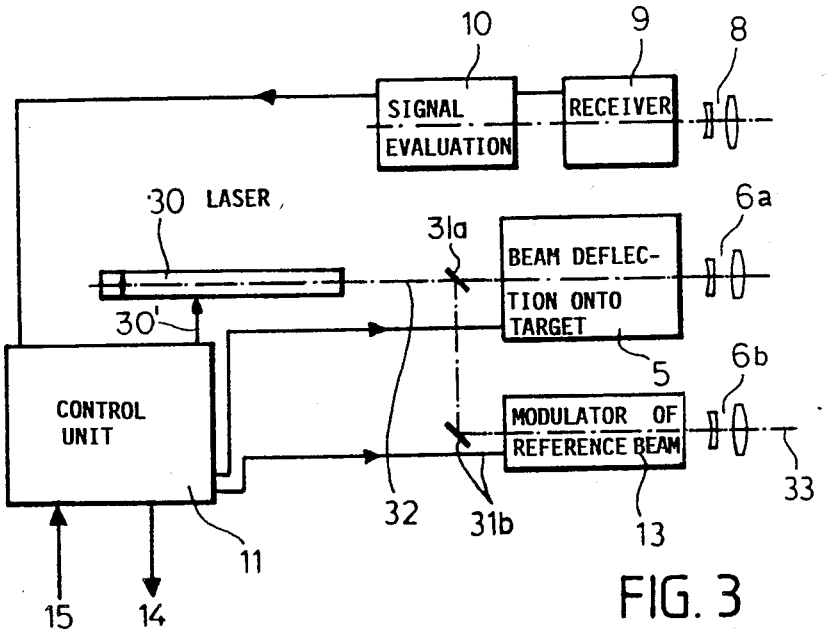
FIG. 3 is a block circuit diagram of a modified and simplified embodiment according to the invention, as compared to FIG. 1, and using a single laser generator in a time multiplex manner for generating a guide laser beam, a reference laser beam, and a tracking beam.

FIG. 3 shows a simple embodiment of the invention in which a single laser 30 is employed for performing sequentially the function of the guide beam laser, the function of the reference beam laser, and the function of the tracking beam laser. The reference beam 33 is produced from a laser beam 32 with the aid of deflection members 31*a* and 31*b*, such as suitable deflection mirrors, which pass the beam through an accoustic optical modulator 13.

The special advantage of the guide beam and tracking system according to the invention resides in that for the first time it has become possible to achieve a highly precise target acquisition with the aid of a beam rider steering system, whereby the precision of the target acquisition is within the same order of magnitude as the precision of the tracking of a flying body toward a target.

In FIG. 3 the laser generator 30 is controlled through an output 30' by the control unit 11 to accomplish the above mentioned sequential generation of the laser beams for the several purposes in a time multiplexing manner. However, where a higher light output ray per unit of time is required, the use of three laser generators 2, 4, and 12, as described with reference to FIG. 1, may be preferable for steering a flying body into a target, whereby the laser beam 1 tracks or scans the target while the guide beam 4 produces the spiral pattern for the location/time coordination of the artillery shell, and the reference beam 12' produces light impulses as a clock signal source. A clock pulse generator is part of the central control unit 11 which also includes a central processing unit such as a microprocessor of conventional construction.

By passing the guide beam 3 and the tracking beam 1 through the same beam deflection device 5 it is possible to increase the light power density while simultaneously simplifying the entire system. This is possible because the tracking laser 2 which scans the target silhouette is always entrained, so to speak, on the spiral track of the guide laser beam 3 and provides its pulses in the desired timed sequence.

The memory 45 of the central control unit 11 has stored therein the program required for the scanning pattern, for example, the spiral pattern shown in FIG. 2, and also of the target silhouette and the reference time or clock signal. The reference laser generator 12 provides light impulses at a defined timed sequence and this timed sequence has a predetermined relationship with the spiral pattern of the guide beam 3, whereby it is possible to coordinate the operation of the three laser beams on a timed basis so that the location and timed coordination of the guide laser beam may be performed. For example, the reference laser provides always an impulse when the guide laser beam passes on its spiral track through a zero degree marker for achieving the desired synchronization of the operation of the three laser beams.

Incidentally, the above mentioned harmonizing means simply brings the optical axis, for example of the tracking laser beam 1, in parallel to the guide beam laser beam 3. This is accomplished by the mirror 16.

Figure 5:
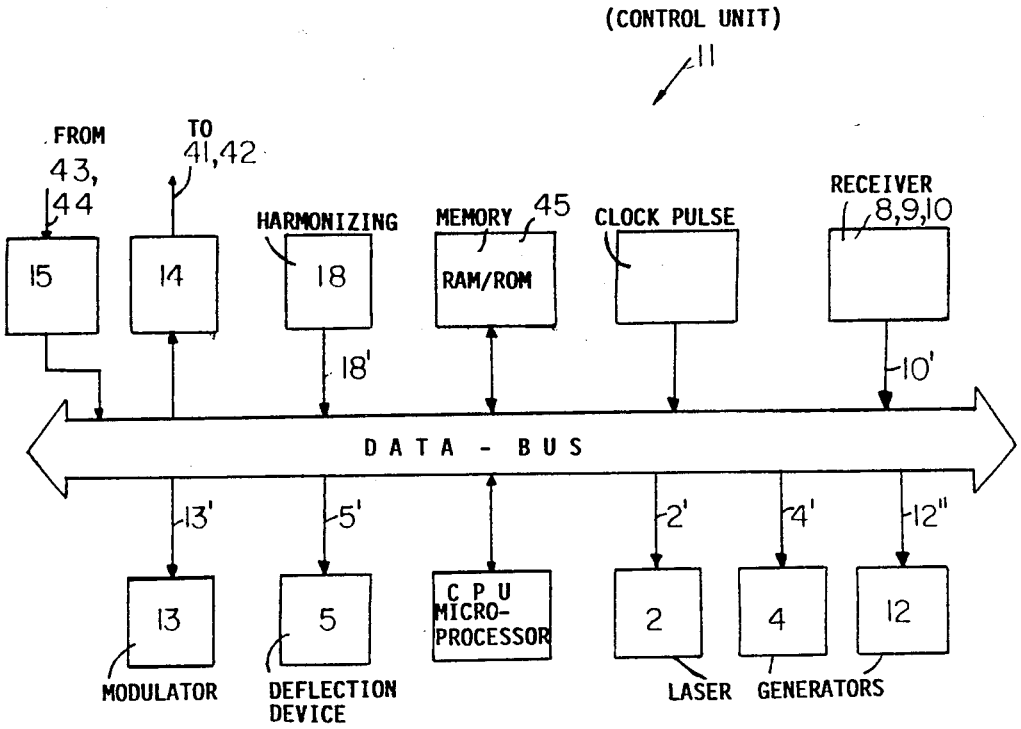
FIG. 5 shows a more detailed functional diagram of the central control unit of FIG. 1.

The following timed sequence for controlling the three laser generators as shown in FIG. 1, and also in FIG. 5 may be employed. The spiral guide beam pattern is produced by the laser 4 followed by a pause. During the spiral guide pattern of the laser 4 the laser 12 provides the reference time or clock pulse until the restarting of the cycle after the pause. During the pause of the guide laser 4 a short data transmission may take place. During the pause of the lasers 4 and 12, the laser 2 produces a tracking impulse or tracking impulses. The control unit further provides for the above mentioned target alignment of the optical axes of the entire tracking unit 40. If desired, a rough alignment may be achieved in response to external signals appearing at the input 15, for example, from the optical sighting device 43 or from the radar unit 44. Following the rough alignment, a fine sighting takes place based on the distance information and the background information received in the receiver 9. This fine alignment is accomplished with the servo-motors 14. Simultaneously, a tracking signal for the laser 2 is provided or generated on the basis of the information received from the receiver 9. Stated differently, on the basis of the edge information of the target silhouette the next points of time for triggering the tracking laser 2 along the spiral deflection pattern are calculated for the purpose of the further edge scanning of the target.

The deflection device 5 may be normally a deflectable mirror or a conventional accoustical, optical deflector. The latter comprises a crystal through which the laser beam is guided. By applying a high frequency signal to the crystal, more specifically to the sides of the crystal extending in parallel to the laser beam, the crystal deflects the laser light from its original direction.

The signal evaluating circuit 10 comprises signal processing circuits of conventional construction for converting the optically received signals into electrical digital signals which are then further processed by the microprocessor in the central control unit 11. A conventional rapidly operating analog-to-digital converter having adaptable thresholds may be used for the circuit 10.

The modulator 13 may, for example, comprise a shutter, or an optical switch or an accoustical optical switch similar to the crystal described for the deflecting device 5.

Briefly, in operation, the scanning or tracking laser beam 1, under the control of the central control unit 11 scans the image point 24 in the search field 23 for a target 21. The reflected light then provides the so-called edge points 25 of the basis on which the microprocessor calculates the center of gravity of the target whereupon the guide beam is trained on the target. The scanning pattern, is stored as a program in the memory of the central processing unit, as mentioned. The searching operation takes place in such a manner that first the spiral scanning makes sure whether or not a target is present at all. Once a target has been acquired, the control unit memorizes, so to speak, the approximate contours of the target, and then only scans the wave lines of the contours of the target.

Although the invention has been described with reference to specific example embodiments, it will be appreciated, that it is intended to cover all modifications and equivalents within the scope of the appended claims.

What we claim is:

1. A guide beam and tracking system for steering a flying body in accordance with the beam rider principle, comprising a first laser generator for producing a guide laser beam (3), a second laser generator for producing a reference laser beam (12'), a modulator arranged for modulating said reference laser beam (12'), a third laser generator for producing a tracking laser beam (1), receiver means for receiving laser light reflected by a target, means for imaging said tracking laser beam (1) of said third laser generator (2) into a path of said guide laser beam (3) produced by said first laser generator (4), an x-y-deflection device (5) provided in common for said guide laser beam (3) and for said tracking laser beam (1), and an optical means (6*a*) also provided in common for passing both said tracking laser beam (1) and said guide laser beam (3) through said x-y-deflection device (5) and through said optical means (6*a*), whereby said guide laser beam and said tracking laser beam are deflected on the same path, said receiver means (9) including input means (8) for receiving reflected laser light (7) and for providing receiver output signals; evaluating circuit means (10) connected to said receiver means for receiving said receiver output signals and measuring a signal amplitude and a transit time for received light, a control unit (11) connected for receiving input signals from said evaluating circuit means (10), said control unit (11) having control output terminals connected for controlling said first, second, and third laser generators (4, 12, 2), said modulator (13) and said x-y-deflection device (5) for target acquisition and for target tracking.

2. The guide beam and tracking system of claim 1, wherein said first and third laser generators comprise a single laser generator means connected to said control unit for producing said guide laser beam and said tracking laser beam in a timed sequence under the control of said control unit (11).

3. A guide beam and tracking system for steering a flying body in accordance with the beam rider principle, comprising laser generator means for generating several laser beams, a central control unit (11) connected to said laser generator means for controlling the laser generator means in timed sequence to produce a guide laser beam, a reference laser beam and a tracking laser beam, a modulator arranged for modulating said reference laser beam, receiver means for receiving laser light reflected by a target, means for imaging said tracking laser beam (1) into a path of said guide laser beam (3), an x-y-deflection device (5) provided in common for deflecting said tracking laser beam and said guide laser beam, and an optical means (31*a*, 31*b*) also provided in common for passing both said tracking laser beam and said guide laser beam through said x-y-deflection device (5) and through said optical means (6*a*), whereby said guide laser beam and said tracking laser beam are deflected on the same path, said receiver means (9) including input means (8) for receiving reflected laser light (7) and for providing receiver output signals; evaluating circuit means (10) connected to said receiver means for receiving said receiver output signals and measuring a signal amplitude and a transit time for received light, said central control unit (11) being connected for receiving input signals from said evaluating circuit means (10), said control unit (11) having control output terminals connected for controlling in a timed sequence said laser generator means, said modulator (13) and said x-y-deflection device (5).

4. The guide beam and tracking system of claim 3, wherein said laser generator means comprise a solid state laser generator.

* * * * *